US010827898B2

(12) United States Patent
Moran

(10) Patent No.: US 10,827,898 B2
(45) Date of Patent: Nov. 10, 2020

(54) SELF-CLEANING CARPET

(71) Applicant: Robert J. Moran, Belmont, MA (US)

(72) Inventor: Robert J. Moran, Belmont, MA (US)

( * ) Notice: Subject to any disclaimer, the term of this patent is extended or adjusted under 35 U.S.C. 154(b) by 0 days.

(21) Appl. No.: 16/718,958

(22) Filed: Dec. 18, 2019

(65) Prior Publication Data

US 2020/0121151 A1 Apr. 23, 2020

Related U.S. Application Data

(60) Provisional application No. 62/782,170, filed on Dec. 19, 2018, provisional application No. 16/010,203, filed on Jun. 15, 2018, provisional application No. 62/520,377, filed on Jun. 15, 2017.

(51) Int. Cl.

| | |
|---|---|
| ***A47L 11/34*** | (2006.01) |
| ***A47L 7/00*** | (2006.01) |
| ***A47L 9/28*** | (2006.01) |
| ***A47L 11/40*** | (2006.01) |
| ***D06G 1/00*** | (2006.01) |

(52) U.S. Cl.

CPC ..... *A47L 11/34* (2013.01); *A47L 7/0004* (2013.01); *A47L 9/2826* (2013.01); *A47L 11/4002* (2013.01); *A47L 11/4011* (2013.01); *A47L 11/4044* (2013.01); *A47L 11/4088* (2013.01); *D06G 1/00* (2013.01); *A47L 7/0047* (2013.01)

(58) Field of Classification Search

CPC ..... E04F 11/00; A47L 11/4011; A47L 11/00; A47L 11/4044; A47L 11/4088; A47L 7/0004; A47L 11/34; A47L 9/2826; A47L 11/4002; A47L 7/0047; D06G 1/00; A47C 1/00

See application file for complete search history.

(56) References Cited

U.S. PATENT DOCUMENTS 3,064,298 A * 11/1962 Jones ..... A47L 23/263 15/310
3,216,043 A * 11/1965 Lipson ..... A47L 13/502 15/310
3,649,994 A 3/1972 Harris
3,786,531 A 1/1974 Borg
(Continued)

OTHER PUBLICATIONS

International Preliminary Report on Patentability received for PCT/US2018/037889, dated Dec. 26, 2019, 6 pgs.

*Primary Examiner* — Benjamin L Osterhout
(74) *Attorney, Agent, or Firm* — Glen E. Schumann; Moss & Barnett

(57) ABSTRACT

A self-cleaning carpet system including a carpet base, a cleaning tube, a piston, a carpet fiber group, a water assembly and a vacuum assembly. The cleaning tube is mounted in the carpet base. The piston is operably mounted with respect to the cleaning tube for movement between a retracted position and an extended position. The carpet fiber group is attached to the piston. When the piston is in the retracted position, the carpet fiber group is substantially inside the cleaning tube. When the piston is in the extended position, at least a portion of the carpet fiber group extends from the cleaning tube. The water assembly is fluidly connected to the cleaning tube for delivering water to the cleaning tube. The vacuum assembly is fluidly connected to the cleaning tube for applying a vacuum to the cleaning tube.

20 Claims, 19 Drawing Sheets

(56) References Cited

U.S. PATENT DOCUMENTS

| | | | | | |
|---|---|---|---|---|---|
| 4,951,345 | A | * | 8/1990 | Nappi, Sr. | A47L 23/263 15/302 |
| 5,870,797 | A | | 2/1999 | Anderson | |
| 5,991,967 | A | * | 11/1999 | Williams | A47L 23/263 15/311 |
| 6,105,201 | A | * | 8/2000 | Min | A47L 23/263 15/302 |
| 6,532,618 | B2 | * | 3/2003 | Koch | A47L 23/263 15/308 |
| 8,973,197 | B2 | * | 3/2015 | Omidi | A47L 23/263 15/36 |
| 9,179,820 | B2 | * | 11/2015 | Mufson | A47L 23/02 |
| 2008/0104782 | A1 | | 5/2008 | Hughes | |
| 2010/0060118 | A1 | * | 3/2010 | Tafil | A47L 23/263 312/237 |
| 2012/0167338 | A1 | | 7/2012 | Williams | |
| 2014/0265092 | A1 | | 9/2014 | Looney | |
| 2016/0015244 | A1 | | 1/2016 | Kang | |

* cited by examiner

SELF-CLEANING CARPET

REFERENCE TO RELATED APPLICATION

This application claims priority to Provisional Applic. No. 62/782,170, filed on Dec. 19, 2018, in addition, this application is a continuation-in-part of Non-Provisional application Ser. No. 16/010,203, filed on Jun. 15, 2018, which claims priority to Provisional Applic. No. 62/520,377, filed on Jun. 15, 2017 the contents of each of which are incorporated herein by reference.

FIELD OF THE INVENTION

The present invention is related to a fiber self-cleaning system for cleaning fibers of a type that may be used in carpets, upholstery, artificial turf, garage floors or other applications where the fibers may be exposed to dirt or other contaminants and need to be cleaned. For exemplary purposes only, the invention will be described primarily in terms of a carpet application with occasional notes about other applications of the system.

BACKGROUND OF THE INVENTION

Many systems and products have been developed for cleaning carpets. For instance, detergents and water may be directly applied by hand or spray canister to carpets. The detergent and/or water are then removed from the carpet by known means, such as absorbent cloths. Hand vacuum scrubbers apply water and detergent directly to the carpet and then vacuum up the detergent, dirt and water for disposal. More sophisticated systems powered by vacuums mounted to vehicles are also used to apply water/steam/detergent and other chemicals to a carpet and then vacuum up the water/steam/detergent and other chemicals and dirt from the carpet for disposal. However, all of these systems require significant manual labor and devices to clean the carpet. There remains a need for a carpet fiber cleaning system that can be automated and require virtually no manual labor or other devices to clean the carpet fibers.

SUMMARY OF THE INVENTION

An embodiment of the invention is directed to a self-cleaning carpet system that includes a carpet base, a cleaning tube, a piston, a carpet fiber group, a water assembly and a vacuum assembly. The cleaning tube is mounted in the carpet base. The piston is operably mounted with respect to the cleaning tube for movement between a retracted position and an extended position. The carpet fiber group is attached to the piston. When the piston is in the retracted position, the carpet fiber group is substantially inside the cleaning tube. When the piston is in the extended position, at least a portion of the carpet fiber group extends from the cleaning tube. The water assembly is fluidly connected to the cleaning tube for delivering water to the cleaning tube. The vacuum assembly is fluidly connected to the cleaning tube for applying a vacuum to the cleaning tube.

Another embodiment of the invention is directed to a method of cleaning a self-cleaning carpet system. A self-cleaning carpet system is provided that includes a carpet base, a cleaning tube, a piston, a carpet fiber group, a water assembly and a vacuum assembly. The cleaning tube is mounted in the carpet base. The piston is operably mounted with respect to the cleaning tube for movement between a retracted position and an extended position. The carpet fiber group is attached to the piston. The water assembly is fluidly connected to the cleaning tube. The vacuum assembly is fluidly connected to the cleaning tube. The piston is positioned in the retracted position where the carpet fiber group is substantially inside the cleaning tube. Water is delivered to the cleaning tube so that the water passes through the carpet fiber group. The vacuum assembly is activated to remove the water from the carpet fiber group. The piston is moved to the extended position where at least a portion of the carpet fiber group extends from the cleaning tube.

BRIEF DESCRIPTION OF THE DRAWINGS

FIG. 15I is a sectional-perspective view of the piston and the guide pin mounted there through.

DETAILED DESCRIPTION OF THE INVENTION

For a thorough understanding of the present disclosure, refer to the following detailed description, including the appended claims, in connection with the above-described drawings. Although the present disclosure is described in connection with exemplary embodiments, the present disclosure is not intended to be limited to the specific forms set forth herein. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The carpet mats 1 of the present invention come, in one embodiment, in square or rectangular carpet mats (see 1 in FIG. 1) that can easily be interlocked in side-by-side relation by means known in the art. These carpet mats may be of varying dimensions, such as 3×4 feet, 4×4 feet, or 2×2 feet. (Other dimensions and configurations, including irregular pieces of mats, can be utilized as well.) These carpet mats are designed to interlock with adjoining mats on any and all sides of the mat.

The mats may be hollow or solid and may be constructed of any durable material that is resistant to chemical, such as rubber, "spongy" or "springy" foam, hard plastic, or sheet metal or other material covered by a chemical or corrosion resistant protective coating, such as rubberized foam. The mats are placed on a floor or steps (or in an alternate use, furniture or other objects) in side-by-side interlocking relation until the desired area of the floor or surface area is covered.

Figure 1A:
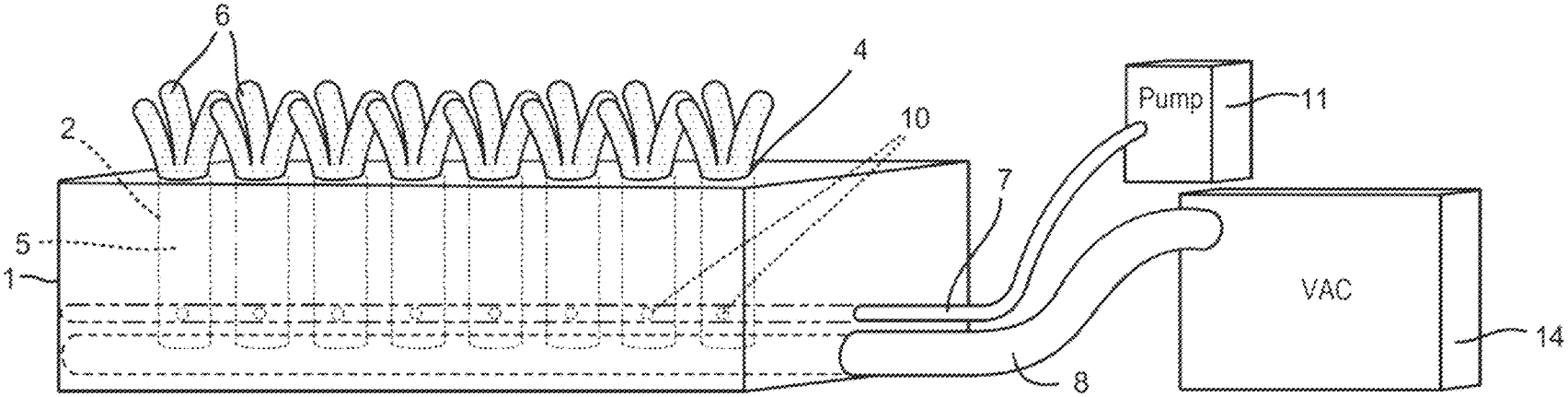
FIG. 1A is perspective view of a carpet mat of the present invention, including a water pump and air and water vacuum.
Figure 1C:
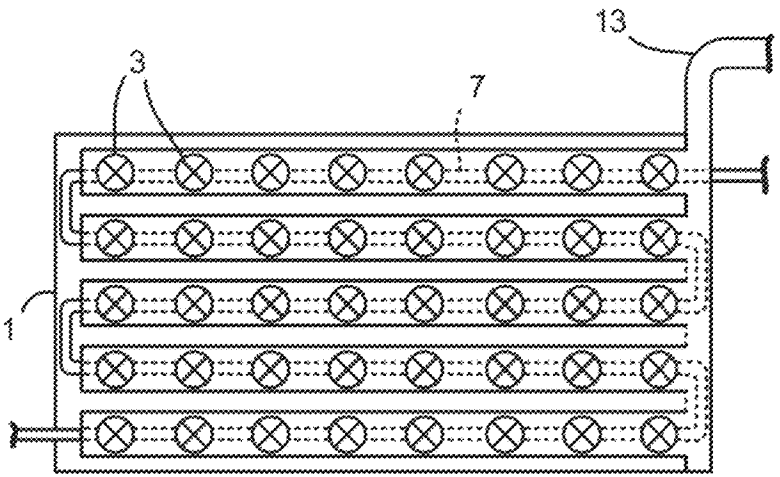
FIG. 1C is the bottom view of a carpet mat of the present invention illustrating the orientation and arrangement of cleaning tubes, a waterline and a vacuum line.
Figure 1B:
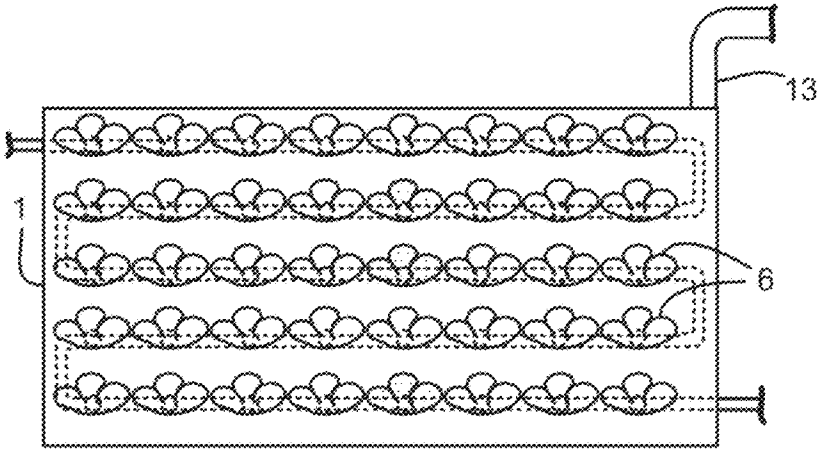
FIG. 1B is a top view of a carpet mat of the present invention.

As illustrated in FIG. 1, carpet mat 1 includes, in one embodiment, a series of cylindrical bores 2 (other configurations are possible) (or openings, if a hollow mat is utilized). These bores are vertically oriented when the mat is placed horizontally on a floor or other surface and are open at the top of the mat. The bores are designed to receive cleaning tubes 3.

Figure 2A:
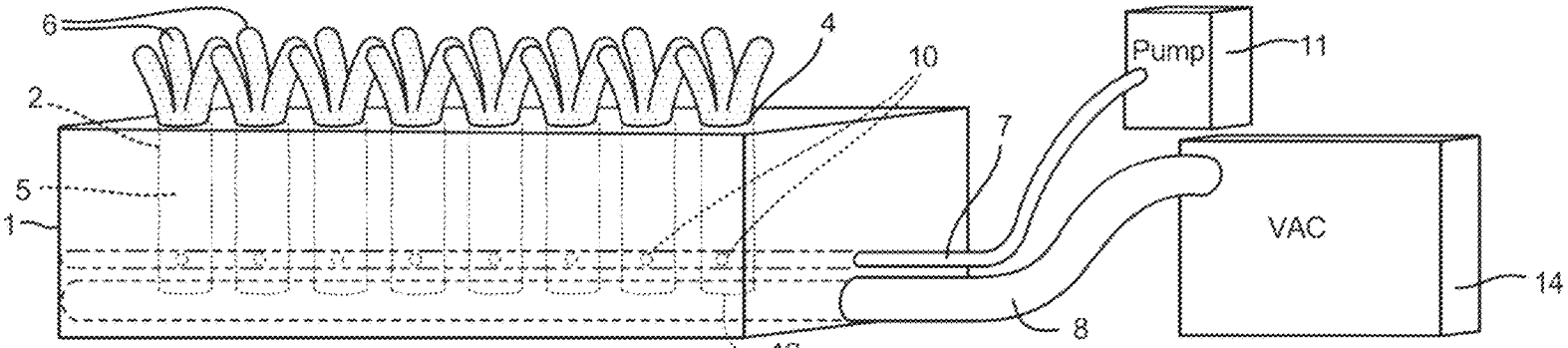
FIG. 2A is a perspective view of a carpet mat of the present invention illustrating the mounting of the carpet fibers within the cleaning tubes and fiber groups.
Figure 2B:
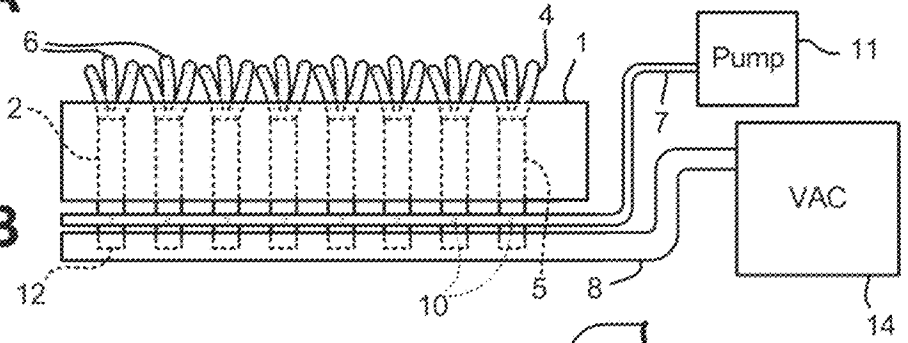
FIG. 2B is a side view of a carpet mat of the present invention illustrating the mounting of the carpet fibers within the cleaning tubes.

The cleaning tubes 3 have an open top 4 and define an internal chamber 5 within which a carpet fiber group 6 is nested (FIGS. 1A, 2A and 2B). In one preferred embodiment, the cleaning tube chamber is beveled (FIG. 3) as discussed below.

The cleaning tubes also include a pair of oppositely placed side orifices, transversely aligned to a longitudinal axis of the tube, for receiving a water line 7. (In an alternative embodiment, the cleaning tubes may have only one side orifice with a water line in fluid communication with the cleaning tube chamber through the one opening.)

Figure 3A:
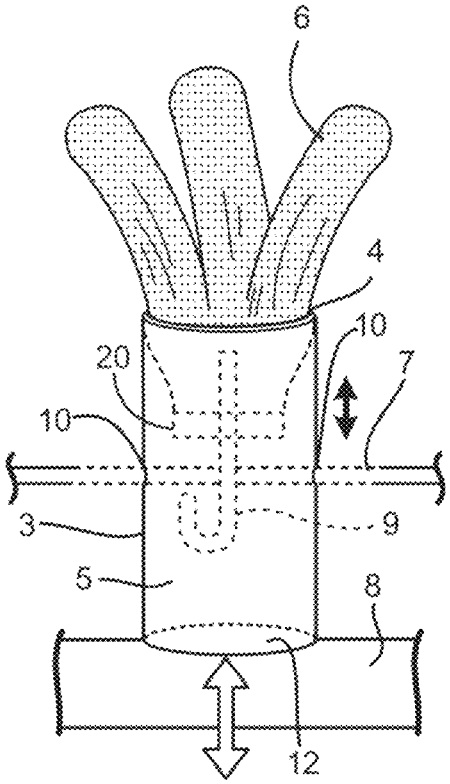
FIG. 3A is a side view of the cleaning tube illustrating its attachment to the vacuum line and waterline and the mounting of the fiber group within the cleaning tube.
Figure 3B:
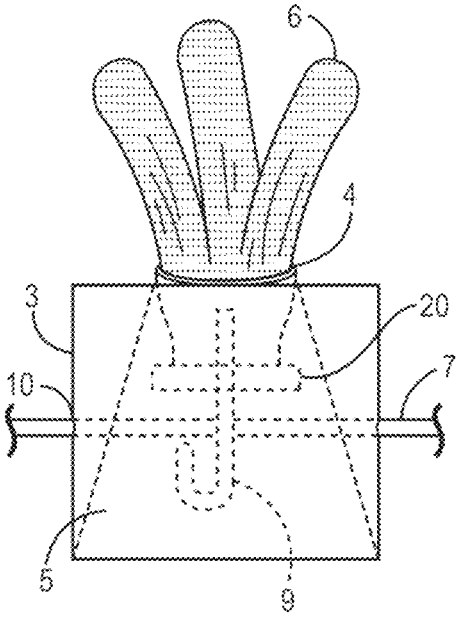
FIG. 3B is a sectional view of a cleaning tube with the fiber group in a lowered or nested position with a beveled version of the cleaning tube chamber.
Figure 3C:
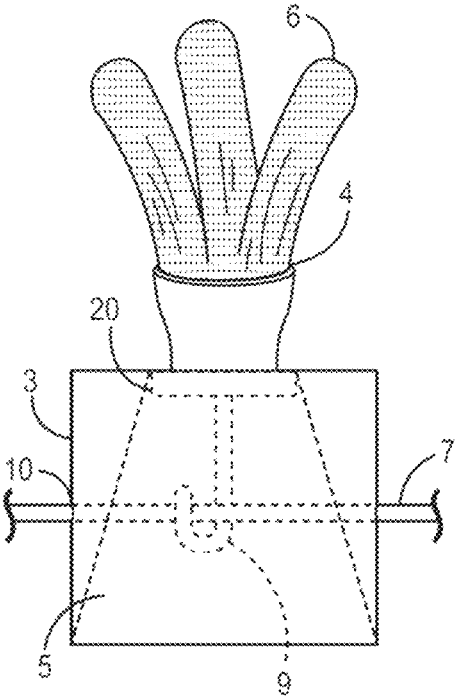
FIG. 3C is a sectional view of a cleaning tube with the fiber group in a raised or cleaning position with a beveled version of the cleaning tube chamber.

In the embodiment where the cleaning tubes have two aligned side orifices, water line 7 is threaded through the cleaning tube transverse orifices as shown in FIGS. 1C and 3. Water line 7 is typically tubular and includes side wall openings 10 positioned within a corresponding cleaning tube chamber to direct fluid (water and/or chemical) into the cleaning tube chamber. In one preferred embodiment, the water line is sized to form a seal with the transversely aligned orifices through which the line passes to prevent water from escaping the cleaning tube through the orifices. Other known mechanisms for sealing the water line and tube orifices to prevent fluid escaping from the cleaning tube chamber through the transverse orifices are also anticipated by the present invention.

Water line 7 may be composed of any suitable, chemical and corrosion resistant material, but in one embodiment, is composed of flexible rubber or silicon.

Carpet fiber group 6 is designed to move up and down in the cleaning tube chamber but is normally nested in a down position with the fibers extending above the opening of the cleaning tube and the bottom of the fiber group near the bottom of the cleaning tube chamber. The carpet fiber group 6 may include one carpet fiber, a bundle of carpet fibers or a grouping of fiber bundles.

In one embodiment, the carpet fibers are secured at a first end to a base 20 mounted inextricably within the cleaning tube chamber. For mounting purposes, the base may collapse when inserted into the cleaning tube chamber, but expand to prevent removal from the chamber. Alternatively, the fiber group may be prevented from being removed from the cleaning tube due to size and/or configuration of the base compared to the size and configuration of the top of the cleaning tube, or an O-ring may be secured to the first end of the fiber group within the cleaning tube (not illustrated) to prevent removal of the fiber group, or the fiber group may be prevented from being removed from the cleaning tube chamber by other means known in the art. The purpose of this arrangement is to prevent the fiber group from being forced out of the cleaning tube chamber by the pressure of water and chemical introduced into the cleaning tube chamber.

In another preferred embodiment illustrated in this application, one end of the fibers are secured to a hook 9 which is designed to engage and disengage the waterline running through the cleaning tube as the carpet fiber group moves up and down, respectively, in the cleaning tube chamber due to introduction of water and chemical into or application of a vacuum force on the cleaning tube chamber. The hook prevents the fiber tube from being forced out of the tube chamber. (In another embodiment, the hook 9 may be designed to engage a ridge at the cleaning tube opening 4.) Other known methods for securing one end of the fibers within the tube so that the fibers may be partially retracted into or extended out of the cleaning tubes, but preventing from being completely withdrawn from the tubes, are also anticipated by the present invention.

The hook can be rigid or flexible, made of metal or plastic or metal coated with galvanized metal or other chemical or chemical or corrosive resistant material, although other materials designed to provide the right strength, rigidity or flexibility or resist corrosion due to water and chemical, are anticipated by the present invention.

The ends of the water line 7 are connected to a water pump 11 which in turn is connected to a water source (not shown). The water line is used to force water and/or chemical through the water line openings into the cleaning tube chambers. (Chemicals include detergents, deodorizers, anti-mold agents and other liquid product that can be added to the water.

More than one waterline may be utilized in the system, depending on the number of cleaning tubes, but typically, only one water line runs through each cleaning tube. These water lines can be connected back to the water source to provide a more even distribution of water throughout the interlocked mats.

Figure 4:
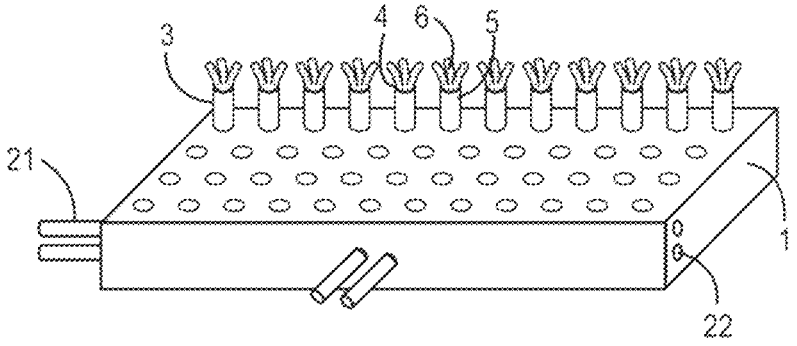
FIG. 4 is a perspective view of an alternate version of a mat, hollow inside, for indirect application of a vacuum force to the cleaning tube chambers.
Figure 5:
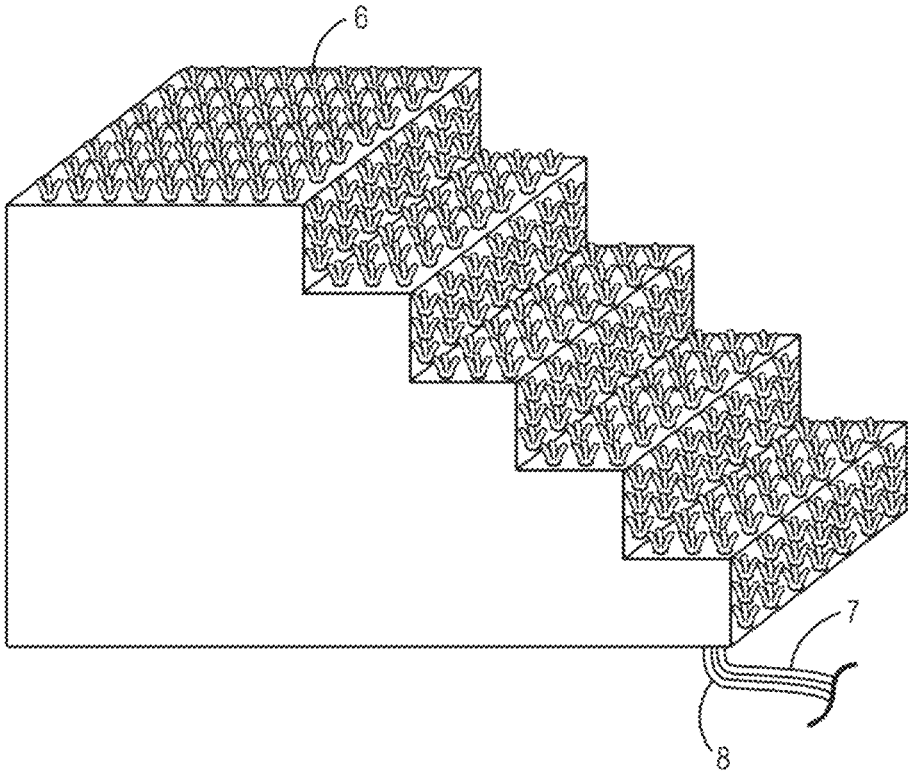
FIG. 5 is a perspective view of steps on a stairway illustrating application of the fiber cleaning invention.
Figure 6:
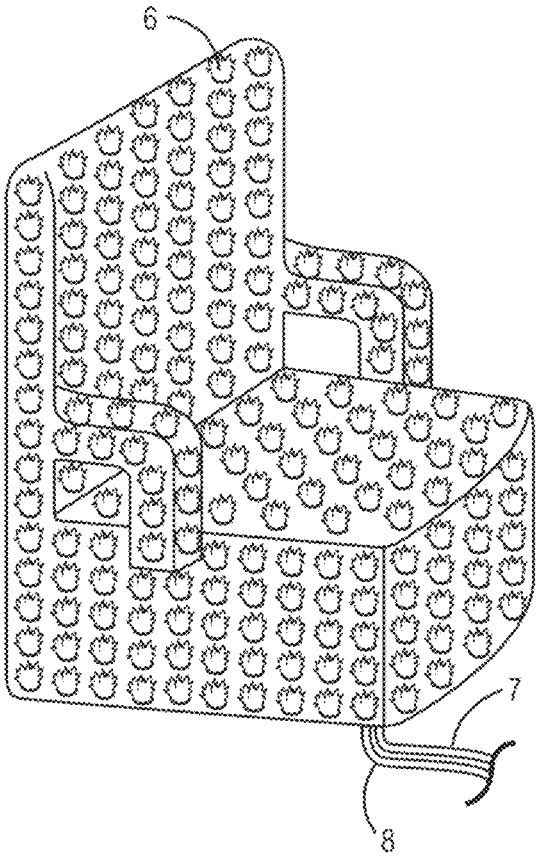
FIG. 6 is a perspective view of an upholstered chair illustrating application of the fiber cleaning invention to furniture.

The cleaning tubes also include an opening 12 for fluid communication between the cleaning tube chamber and a vacuum or vacuum line. In one embodiment, a vacuum force may be applied to the cleaning tube chamber through a connected vacuum line 8 (FIG. 1A). If a hollow mat is utilized, a vacuum force may be applied to the interior of the hollow mat that then indirectly applies a vacuum force on the cleaning tube chambers, as shown in FIG. 4. Two preferred embodiments are a vacuum in fluid communication with the hollow interior of a hollow mat to apply a vacuum force on the cleaning tube chambers, as shown in FIG. 4, or a vacuum line running from the vacuum directly to the cleaning tube chambers, as shown in FIG. 1A.

The vacuum draws water, chemical and dirt out of the cleaning tubes. More than one vacuum line may be utilized depending on the number of cleaning tubes. In one embodiment, one vacuum line attaches to a group of cleaning tubes, but there is typically no need to connect any particular cleaning tube or group of cleaning tubes to more than one vacuum line. (In the embodiment where vacuum force is applied to the hollow interior of the mat, there are no vacuum lines connected to the cleaning tubes.)

In one preferred embodiment, the vacuum and water lines are secured to the bottom of the mat and each mat is sealed on the bottom to prevent leakage. The water and vacuum lines mounted on each mat include connectors at each end for connection to corresponding water and vacuum lines on other interlocked mats. The means for interlocking the water lines and vacuum lines of adjoining mats include a threaded connector, quick connector or any other method for connecting pipes or lines known in the art (including but not limited to: connectors for water lines, electrical lines, gas lines, etc.). The vacuum connections can be connected directly to the vacuum as well. This allows for more even suction across the entire breadth of the carpeted area.

In another preferred embodiment, vacuum "lines" are defined by bores running through a foam or solid mat (no parallel tubes), which function in the same manner as actual vacuum lines.

Referring to FIG. 4, a hollow mat may include both vacuum and water line or channel male connectors 21 on two sides of the mat and two female connectors 22 on the other two sides of the rectangular mat, so that mating mats can be interlocked to create continuous water and vacuum "lines" or connections throughout the mat system. Once the desired floor or surface area is covered by the mats, in order to create the desired vacuum force and prevent water and chemical spillage, open water and vacuum connectors may be capped or sealed by known means.

Figure 2C:
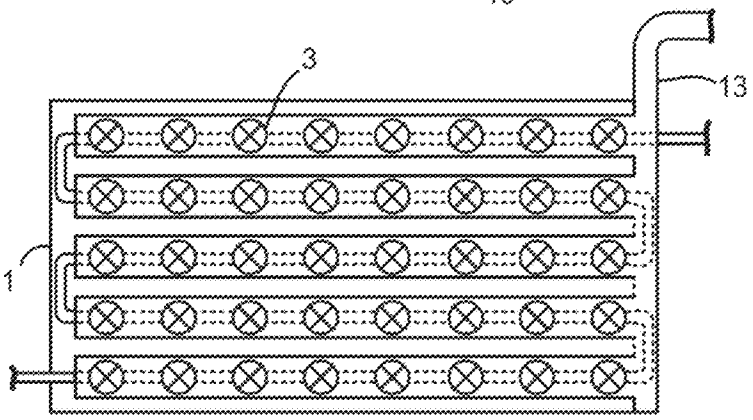
FIG. 2C is a bottom view of a carpet mat of the present invention illustrating the mounting of the cleaning tubes and the generally parallel alignment of the water and vacuum lines throughout the foam mat.

In one embodiment, as shown in FIG. 2C, multiple vacuum lines are mounted below or along a bottom edge of the mat. The vacuum lines are in spaced parallel alignment extending along the length of the mat. A transverse vacuum line 13 is mounted below or along a bottom edge of the mat, transverse to the parallel vacuum lines, in fluid communication with a first end of each of the parallel vacuum lines. The transverse vacuum line is in turn connected to a vacuum 14 which in turn is connected to a water disposal system (not shown). The water disposal system can be any known system in the art, such as a drain, a drain hose leading to a drain, a filtered recycling unit, a container, etc.

The vacuum system can be utilized as a blower to force air through the carpet fibers to dry the same. After the carpet fibers are cleaned, the vacuum is reversed, blowing drying air on the fibers to blow off moisture. Alternatively, a vacuum force can be applied to the carpet fibers until dry.

A control system (not shown) controls operation of the pumps, allowing for adjustment of time and extent of use of the system, water pressures, additives and other features of the invention.

In operation, water and/or chemical is pumped through the water line, water line orifices 4, into the cleaning tube chambers on command from the control system. Water and chemical engage the carpet fiber groups and force the carpet fiber groups to move upward in the cleaning tubes and the carpet fibers are washed with the water and chemical. The hooks on the carpet fiber groups engage the water line, preventing the fiber groups from being pushed out of the cleaning tube. A vacuum is then applied, drawing the carpet fiber group back into the cleaning tube and drawing the water, chemical and dirt back to the vacuum disposal system. This "wash" and "rinse" action of the water line and vacuum draw water, chemical and dirt out of the carpet fiber groups. This process may be repeated, alternating between introducing water and chemical, or just water, and vacuuming out the water, chemical and dirt, until the carpet fibers are cleaned. The vacuum pump is then reversed to blow air through the carpet fiber groups to help dry the fibers.

In another preferred embodiment, the carpet fiber groups do not move up and down in the cleaning tube chambers, but are held in place, but water and chemical nevertheless wash over the carpet fibers and the vacuum can be used to draw out the water, chemical and contaminants or dirt to clean the carpet fibers.

In one preferred embodiment, a moisture sensor is added to the system at various locations on the carpet mats to detect spilled liquids (such as spilled drinks or animal urine) or identifying flooding of the carpet, triggering automatic operation of the system to remove the undesired liquid. The sensor can be a hard wired mat-to-interlocked mat to controller, or a wireless system including sensors strategically placed, read by a signal receiving unit operatively connected to the control system to turn on the vacuum. In areas where flooding occurs from time to time, this system is particularly advantageous to address flooding conditions as early as possible.

In one preferred embodiment, light emitting diodes can be added to the carpet mats in the same fashion as the moisture sensing system to identify spills, areas that have or have not been cleaned or to provide other desired information to the control system.

In another preferred embodiment, the water and detergent may be introduced through a single orifice in the cleaning tube and the vacuum and blower force may be applied through a line or channel in fluid communication with the cleaning tube at the cleaning tube orifice.

Other improvements of the fiber self-cleaning system include an allergy free environment and elimination of dust mites, among other things.

Figure 7:
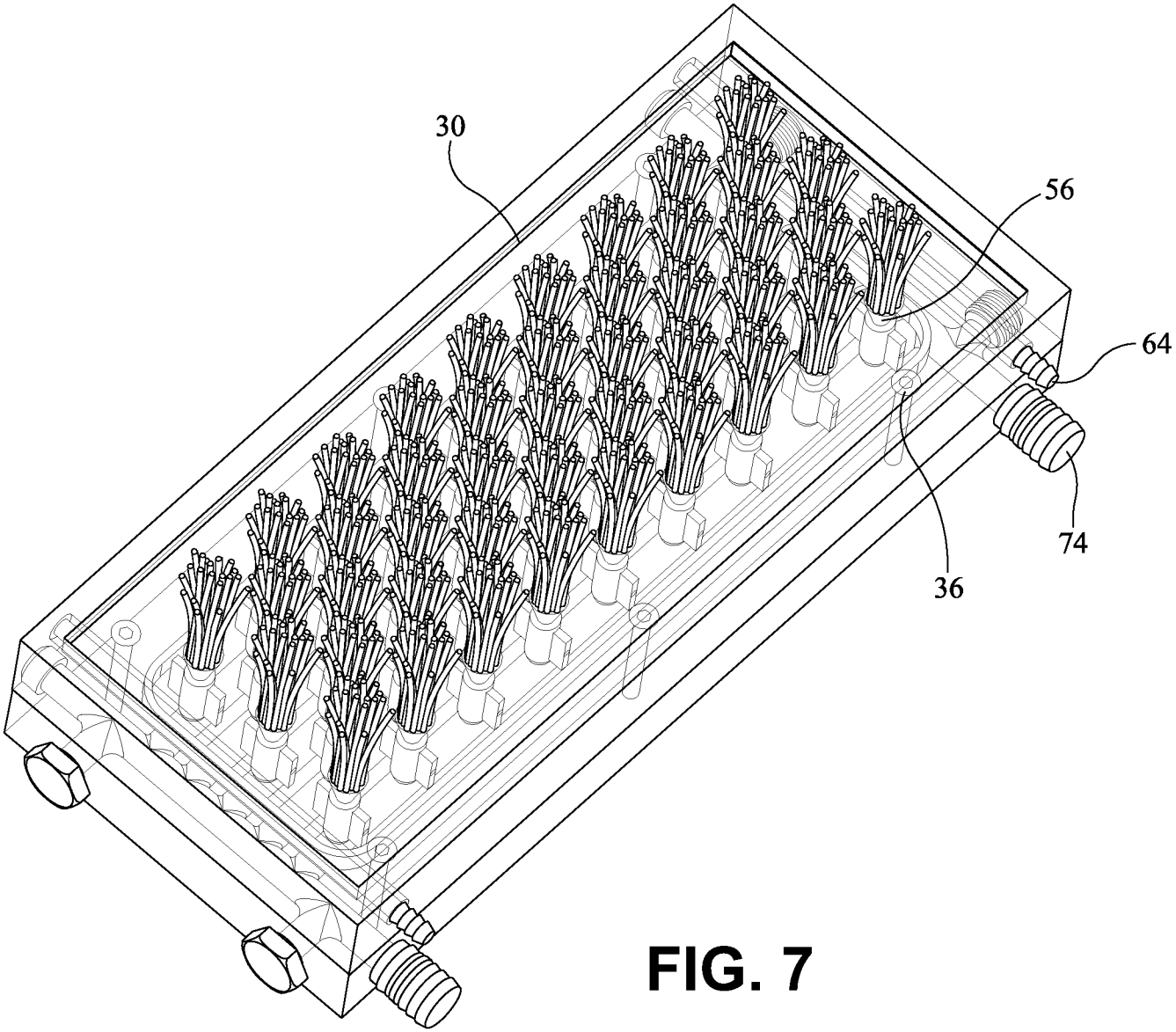
FIG. 7 is a perspective view of one embodiment of the carpet panel with some of the internal plumbing portions not shown.
Figure 8:
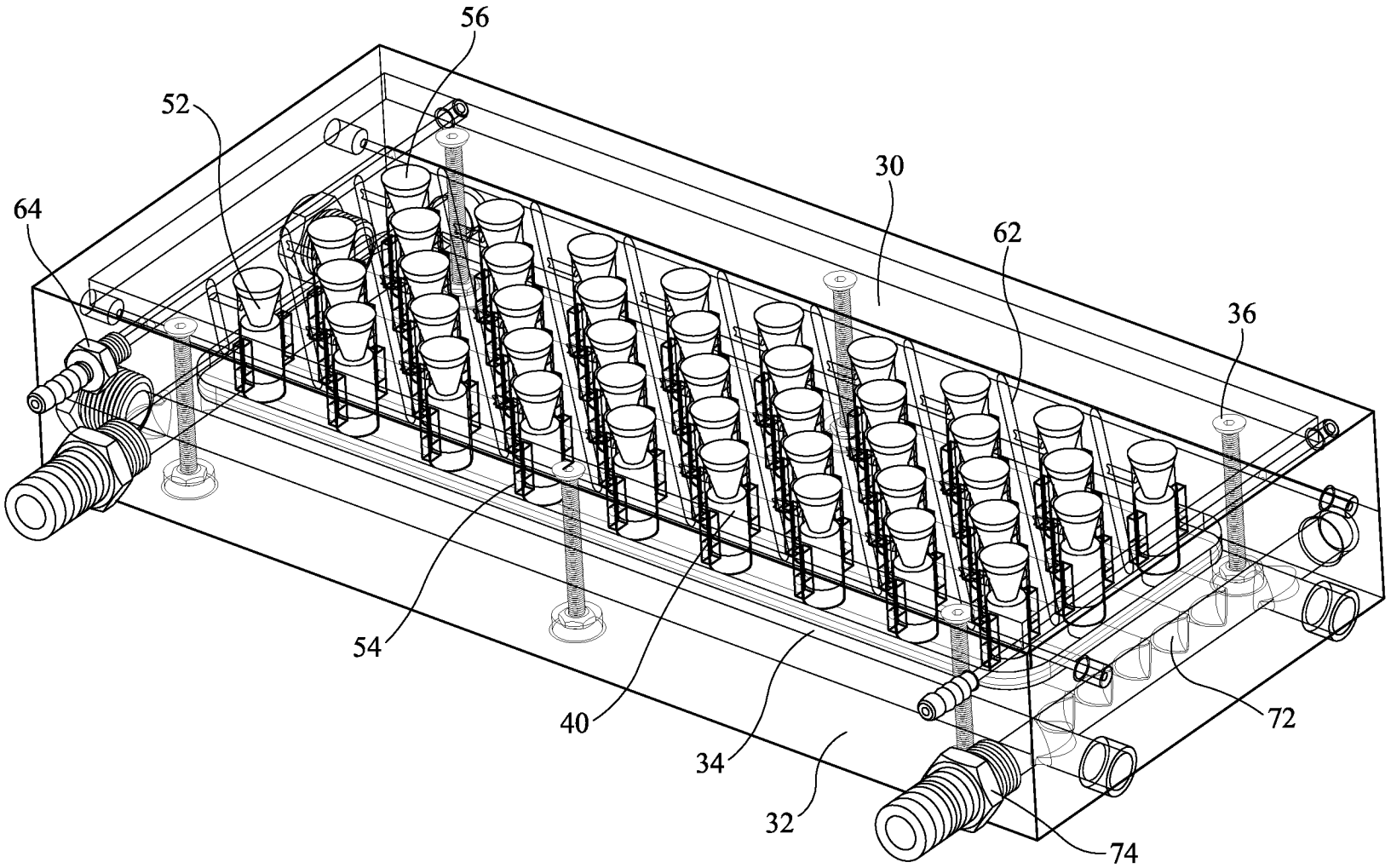
FIG. 8 is a perspective view of the carpet panel illustrating the internal plumbing.
Figure 9:
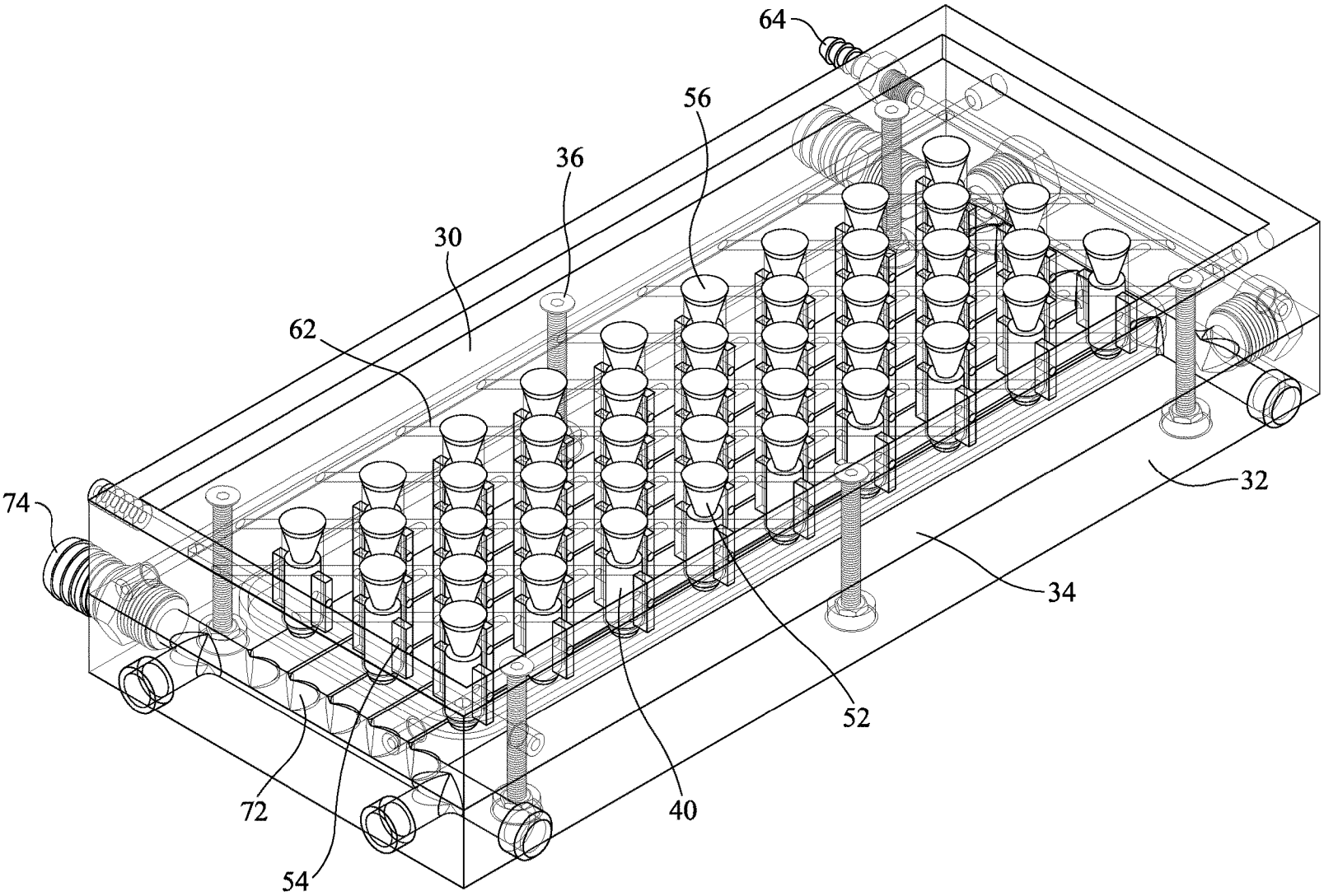
FIG. 9 is the perspective view of the carpet panel, opposite that shown in FIG. 8, illustrating the internal plumbing of the carpet panel.
Figure 10:
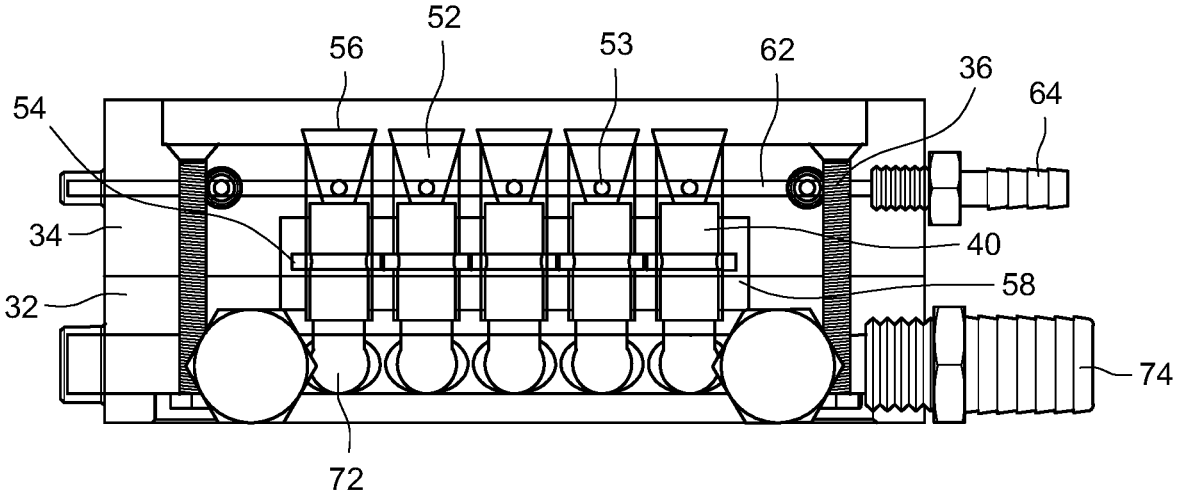
FIG. 10 is a front view of the carpet panel of FIG. 8 illustrating the internal plumbing of the carpet panel.
Figure 11:
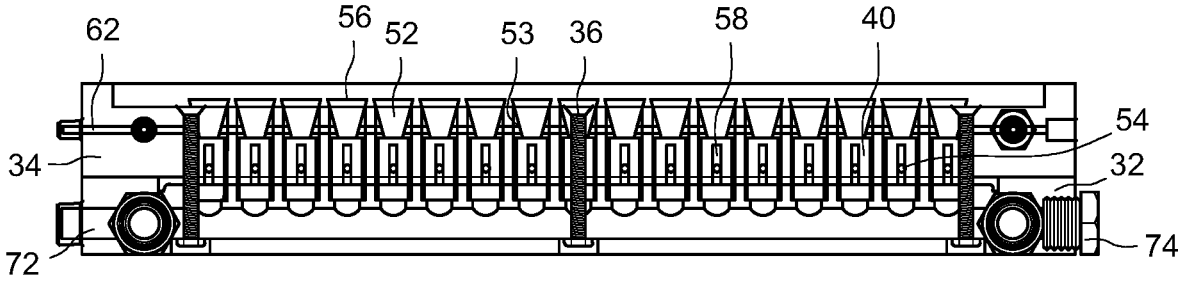
FIG. 11 is a side view of the carpet panel of FIG. 8 illustrating the internal plumbing of the carpet panel.
Figure 12:
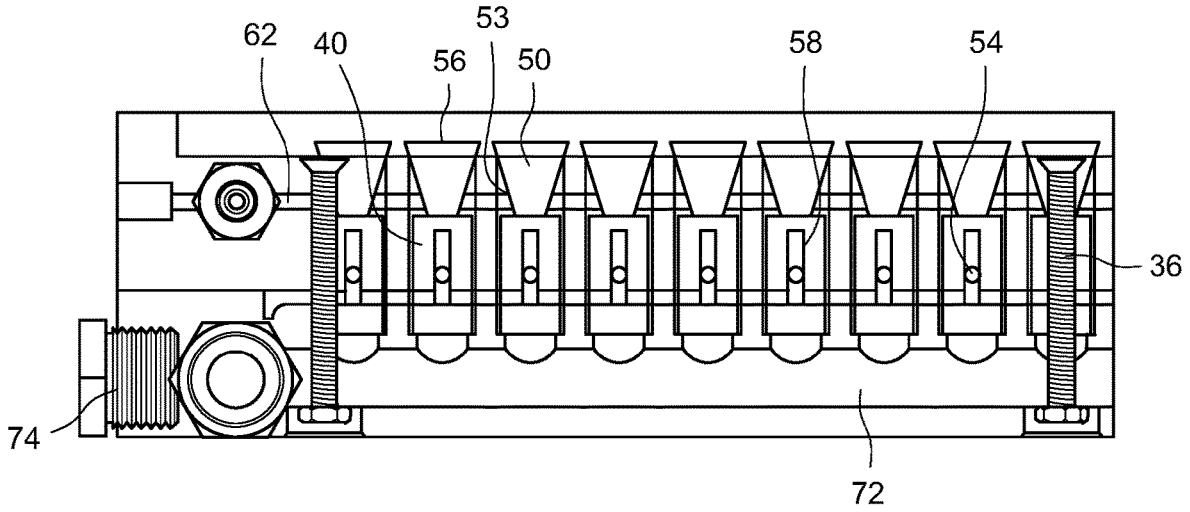
FIG. 12 is an enlarged inside view of the carpet panel of FIG. 8 illustrating the internal plumbing of the carpet panel.

FIGS. 7-14 identify an alternate embodiment of the present invention. The alternate embodiment, as shown in FIG. 7, includes a carpet base 30. In certain embodiments, the carpet base 30 includes a lower base portion 32 and an upper base portion 34.

The lower base portion 32 and the upper base portion 34 may be removably held together using a fastener that permits separation of the lower base portion 32 and the upper base portion 34. Non-limiting examples of suitable fasteners include screws or bolts 36. Alternatively, the upper base portion 34 and the lower base portion 32 may be permanently mounted to each other.

Collectively, the upper base portion 34 and the lower base portion 32 create a hollow container for holding the working components of this embodiment of the self-cleaning carpet. As discussed infra, this embodiment is for illustrative purposes and alternate embodiments are anticipated by the present invention.

The upper base portion 34 and the lower base portion 32 are shown consisting of transparent rigid material, such as transparent plastic, for illustrative purposes, to better show the components within the carpet base 30. The carpet base 30 could include the upper base portion 34 or the lower base portion 32 as shown, or consist of a single component with cutouts to receive the internal components.

The carpet base 30 could be made of rigid or flexible material, and in one embodiment, a rubber or foam material that acts as a natural padding for the carpet. The carpet base 30 can be transparent or opaque or something in between.

Mounted to and within the carpet base 30 is a water assembly 60, a vacuum assembly 70 and cleaning tubes 40 in each of which are mounted a corresponding piston 50. While the cleaning tubes 40 are illustrated as having a cylindrical shape, it is possible for the cleaning tubes 40 to have other configurations using the embodiments of the invention.

The water assembly 60 may consist of a main or master water line 64 connected to a series of smaller water delivery lines 62. The water delivery lines 62 extend through carpet base 30 and are in fluid communication with the cleaning tubes 40. In certain embodiments, the water delivery lines 62 are in fluid communication with an upper end of each of the cleaning tubes 40.

Figure 13A:
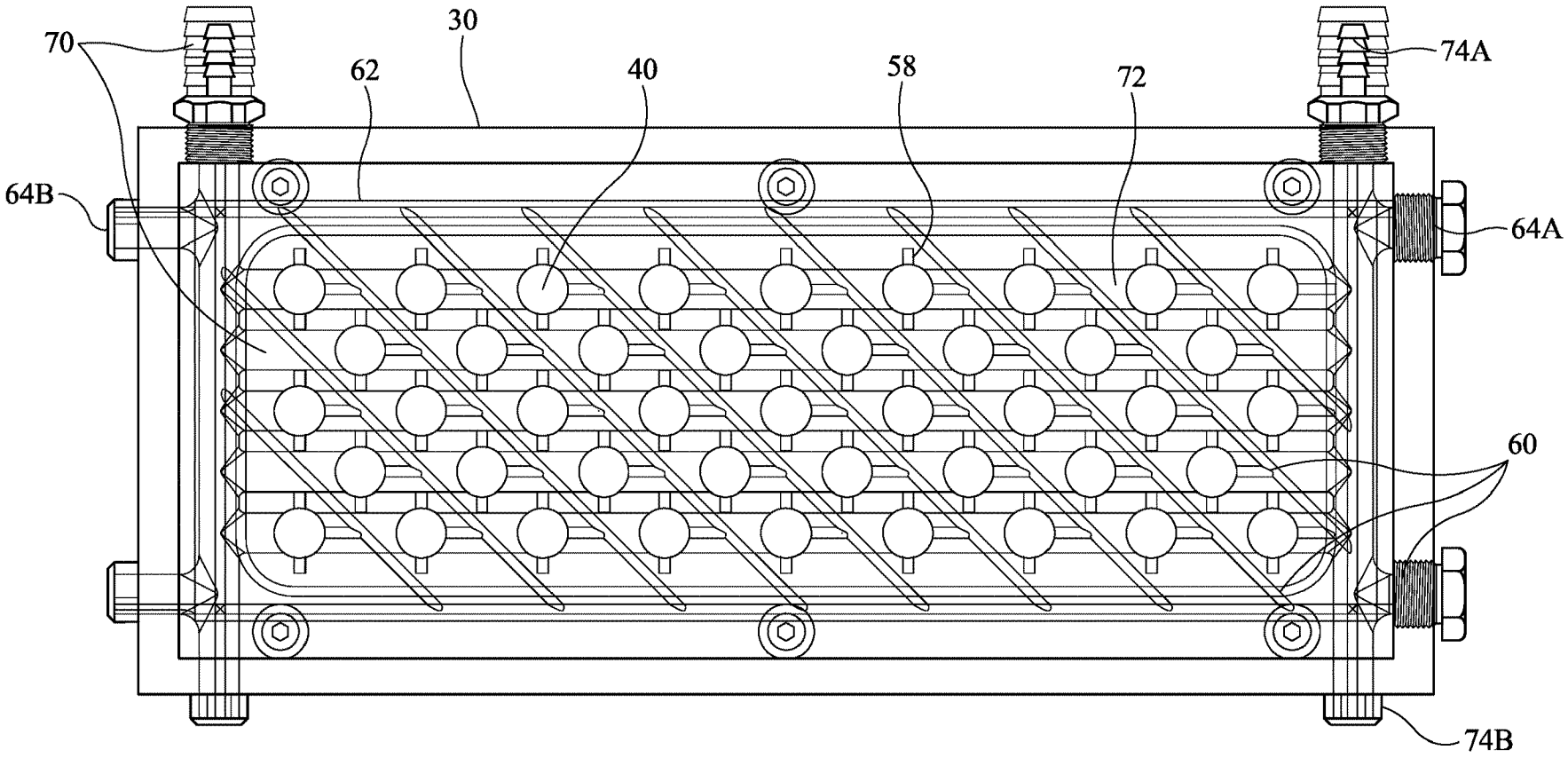
FIG. 13A is a top view of the carpet panel of FIG. 8 illustrating the internal plumbing of the carpet panel.
Figure 13B:
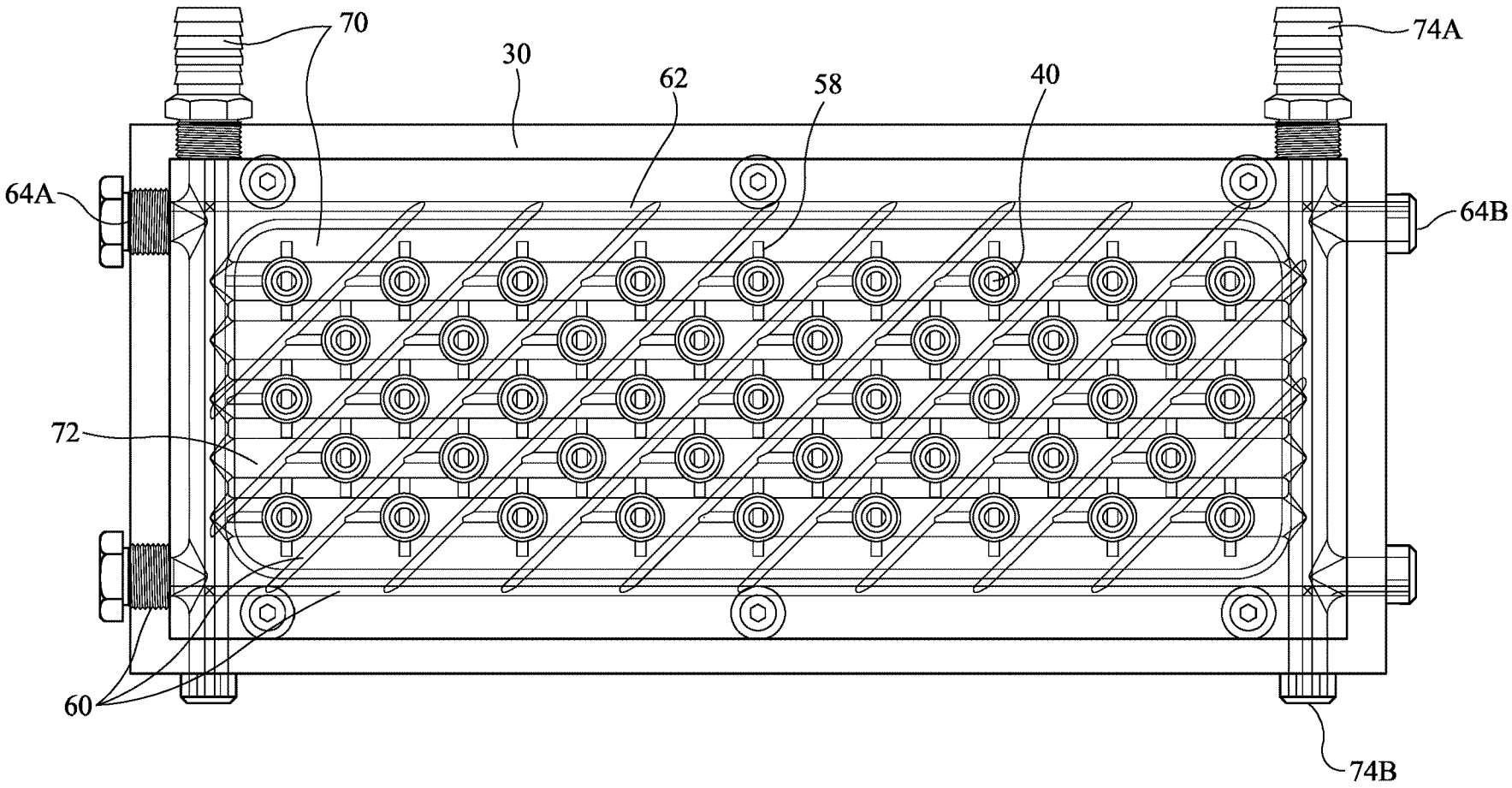
FIG. 13B is a bottom view of the carpet panel of FIG. 8 illustrating the internal plumbing of the carpet panel. Carpet fibers are not shown in this view.
Figure 14A:
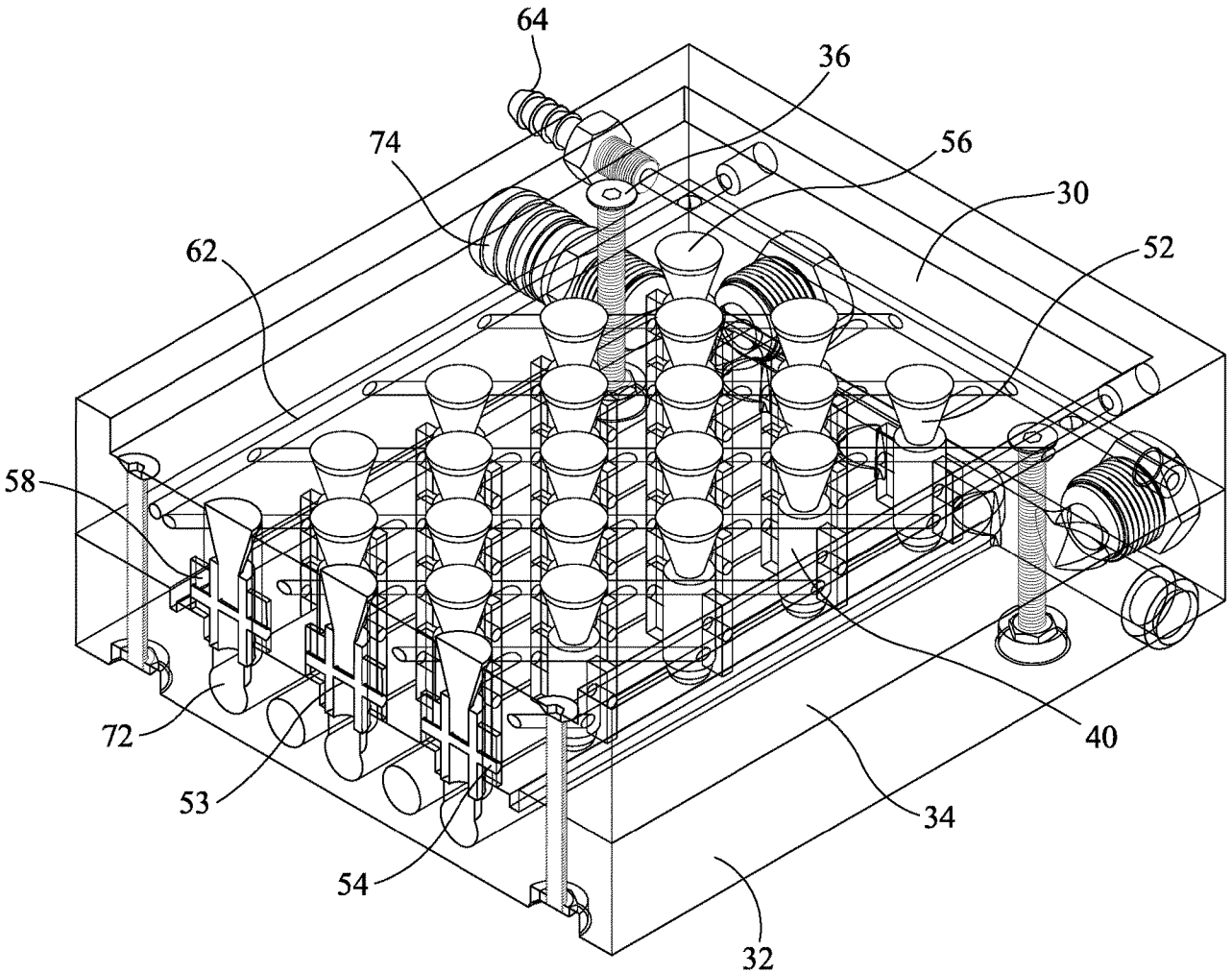
FIG. 14A is a sectional perspective view of the carpet panel of FIG. 8, sectioned along a first side of the carpet panel.
Figure 14B:
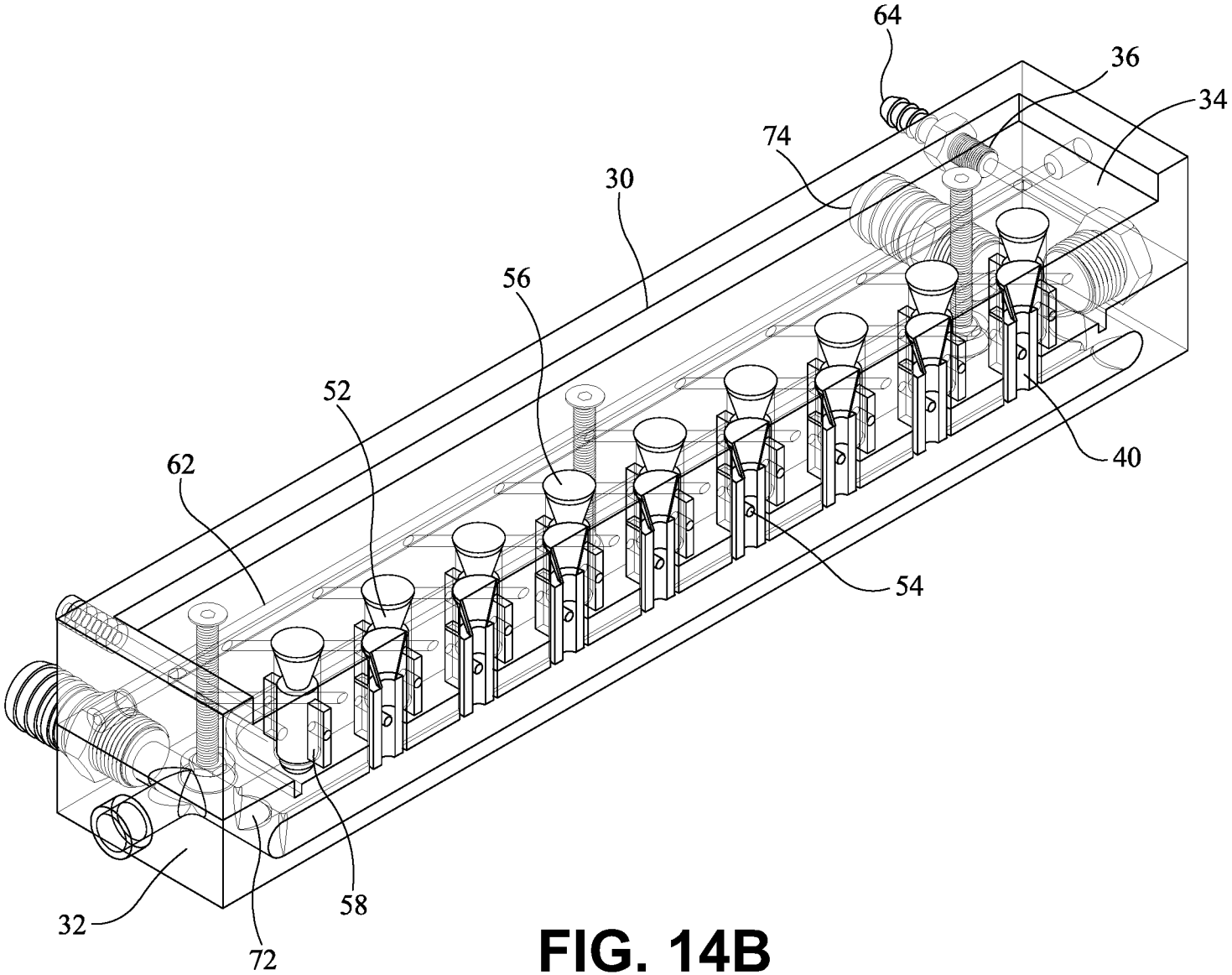
FIG. 14B is a sectional-perspective view of the carpet panel of FIG. 8, sectioned along a second side of the carpet panel.

In addition to delivering water, the water delivery lines 62 may also deliver detergent and other chemical to the cleaning tubes 40 to enhance the ability to clean the carpet fibers that are attached to the piston 50 mounted within the cleaning tubes 40. The master water line 64 partially extends outside the carpet base as illustrated in FIG. 13A & 13B (inlet 64A, outlet 64B) to either connect to a fluid source or to master water lines of an adjoining carpet base, which in turn is operatively connected to another carpet base or a fluid source. In this manner, water, detergent and other chemical are delivered throughout an integrated carpet panel system to the cleaning tubes 40 and carpet fibers 56.

The vacuum assembly 70 may consist of a master vacuum line 74 connected to a series of smaller vacuum delivery lines 72. The vacuum delivery lines 72 are in fluid communication with the cleaning tubes 40. In certain embodiments, the vacuum delivery lines 72 are in fluid communication with a lower end of each of the cleaning tubes 40.

The vacuum delivery lines 72 deliver a positive or negative air pressure to the cleaning tubes 40 to draw water, chemical, and dirt away from the carpet fibers 56 and from within the cleaning tubes 40.

The master vacuum line 74 partially extends outside the carpet base 30 as illustrated at FIG. 13A & 13B (inlet 74A, outlet 74B) to either connect to a vacuum source or master vacuum lines of an adjoining carpet base, which in turn is operatively connected to another carpet base or a vacuum source.

The cleaning tubes 40 have an open upper end 41 and define a generally cylindrical bore for receiving a piston 50. The cleaning tubes 40, the vacuum delivery lines 72 and the water delivery lines 62 are mounted within the "container" or "compartment" created by the upper base portion 34 and the lower base portion 32, as illustrated in the drawings. As stated above, the cleaning tubes 40 are in fluid communication with the water delivery lines 62 and the vacuum delivery lines 72.

Mounted within each of the cleaning tubes 40 is one of the pistons 50. Referring to FIGS. 15A-15I, each piston 50 includes a cylindrical base 52 having a longitudinal axis. The cylindrical base 52 receives a guide pin 54. The transverse bore 53 extends through the cylindrical base 52 transverse to the longitudinal axis of the cylindrical base 52.

Figure 15A:
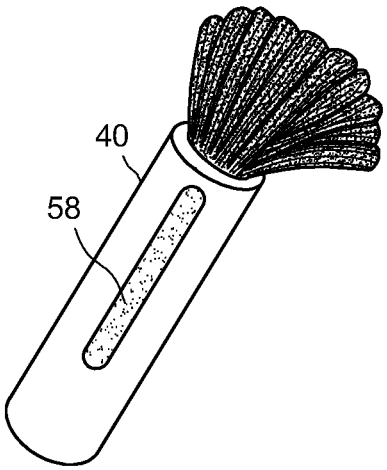
FIG. 15A is the piston/cleaning tube assembly without the guide pin used in the carpet panel shown in FIG. 8.
Figure 15B:
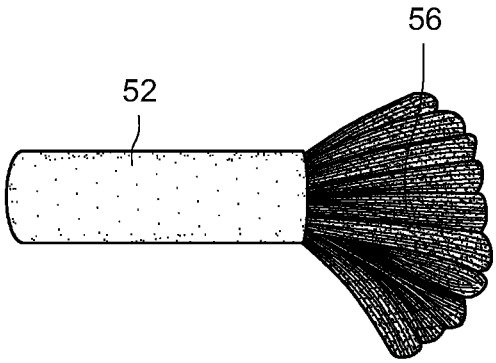
FIG. 15B is a piston without the guide pin or pin guide used in the carpet panel shown in FIG. 8.
Figure 15C:
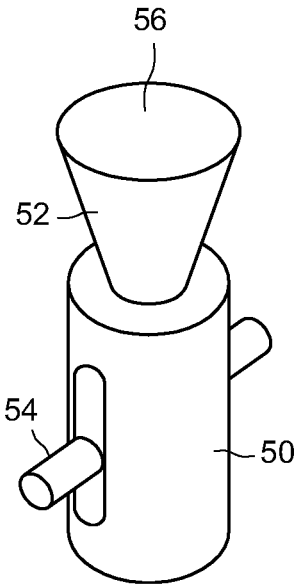
FIG. 15C is a perspective view of the carpet piston.
Figure 15D:
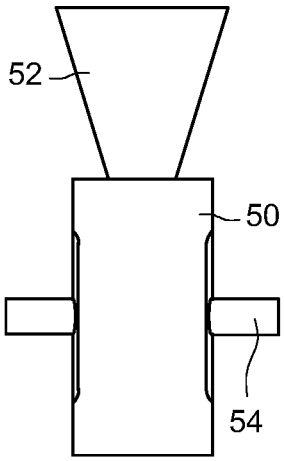
FIG. 15D is front view of the carpet piston.
Figure 15E:
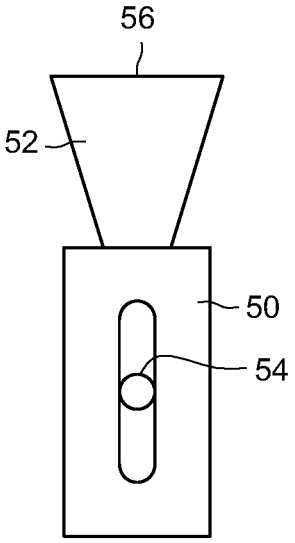
FIG. 15E is a side view of the carpet piston.
Figure 15F:
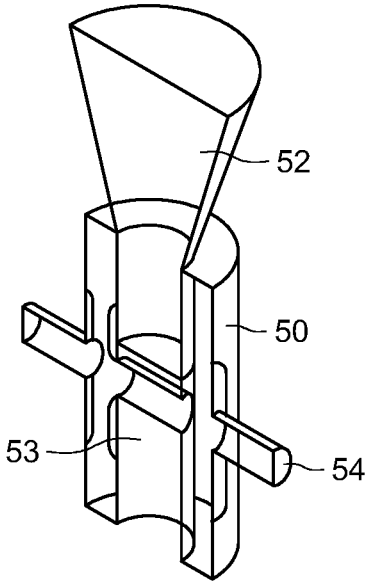
FIG. 15F is a sectional-perspective view illustrating the cleaning chamber/ tube of the carpet piston.
Figure 15G:
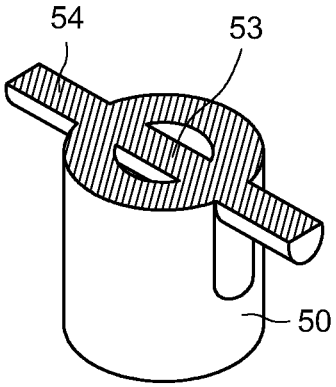
FIG. 15G is a sectional-perspective view illustrating the pin within the cleaning chamber/tube of the carpet piston.
Figure 15H:
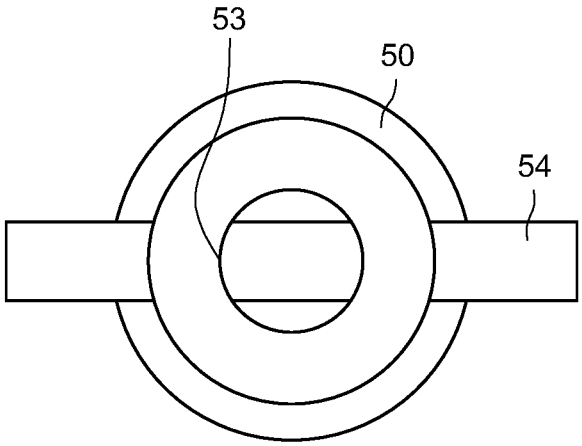
FIG. 15H is a bottom view of the carpet piston.
Figure 15I:
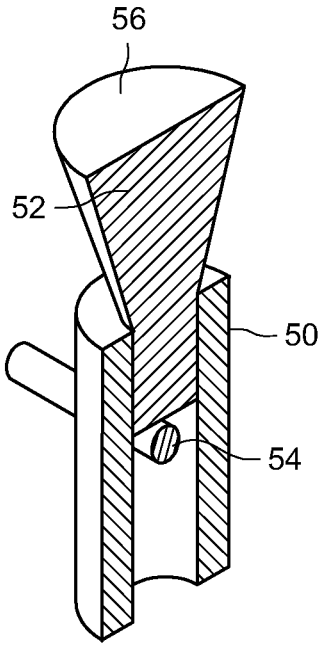

The guide pin 54 is mounted within the cylindrical base 52 such that at least one of the opposite ends of the guide pin 54 extends partially outside opposite sides of the cylindrical base 52, and a carpet fiber group 56 mounted at one end of the cylindrical base 52. FIG. 15B is a picture of the piston cylindrical base 52 with a carpet fiber group 56 mounted at one end. No guide pin is shown in FIG. 15B.

The piston 50 is mounted within each cleaning tube 40 with the carpet fiber group 56 located at the open (top) end 41 of the cleaning tube 40. The piston 50 can be moved between an extended position and a retracted position by the force of the vacuum or water. When in the extended position, the carpet fiber group 56 extends above the open end of the cleaning tube 40. When in the retracted position, the carpet fiber group 56 is positioned substantially within the cleaning tube 40.

Each cleaning tube 40 also includes two parallel, opposed slots or pin guides 58 running partially along the length of the cleaning tube 40. When the pistons 50 are mounted within the cleaning tubes 40, the opposing ends of the guide pins 54 extend into these slots 58.

The piston 50 is free to move up (extended position) or down (retracted position). The cleaning tube 40, is limited by the engagement of the guide pin 54 ends with the walls of the cleaning tube 40 that define the opposed slots or pin guides 58.

In this manner, movement of the piston 50 is restricted and the pistons 50 cannot be removed or escape the cleaning tubes 40 without removal of the guide pins 54. From an assembly standpoint, the pistons 50 minus the guide pins 54 are first mounted within the cleaning tube 40. The guide pin 54 is then inserted through the opposed slots or pin guide 58 in the tube and through the transverse bore 53 of the cylindrical base 52 of the piston 50 so that a first end of the guide pin 54 extends into a first slot or pin guide 58 of the cleaning tube 40, and a second opposite end of the guide pin 54 extends into an opposite second slot or pin guide 58 of the cleaning tube 40. A person of skill in the art will appreciate that alternate techniques may be used to mount the pistons 50 in the cleaning tubes 40 to permit the pistons 50 to move between the extended position and the retracted position.

In operation, ideally with the piston 50 in its extended position, water is pumped through the water delivery lines 62 into engagement with an upper portion of the cleaning tubes 40, spraying water and chemical on the carpet fiber groups 56. A vacuum pressure is then applied to the cleaning tubes 40 through the vacuum delivery lines 72 to draw the water, chemical and any dirt or contaminant contained within the carpet fiber groups 56 into the vacuum delivery lines 72. In certain embodiments, the water delivery and removal may be done simultaneously. The water, chemical and dirt drawn through the vacuum delivery lines 72 may be drawn to a filtering system for possible reuse or simply drawn away for disposal.

After the carpet fiber groups 56 have been cleansed in this fashion, the water delivery lines 72 are shut off and the vacuum will continue to be applied to the cleaning tubes 40 and pistons 50 as before to siphon off as much water, chemical and contaminant as possible from the carpet fiber groups 56.

A reverse (positive) vacuum pressure can then be applied to the cleaning tubes 40 and pistons 50 through the vacuum delivery lines 72, forcing the pistons 50 into their extended position with the carpet fiber groups 56 extending from the top of the cleaning tubes 40. The air blowing through the carpet fiber groups 56 will drive moisture off of the carpet fibers to dry them. In this orientation, the positive vacuum can also be shut off, allowing the carpet fiber groups 56 to air dry.

In the drawings, the water delivery lines 62 are shown running at an angle within the carpet base 30 and the cleaning tube 40 and pistons 50 are oriented in an offset fashion. This is for illustrative purposes only; any configuration of the cleaning tubes 40 and pistons 50, water delivery lines 62 and vacuum delivery lines 72 are anticipated by the present invention.

The master water and vacuum lines 64, 74 that extend outside the carpet base may include couplings of a type known in the prior art to engage couplings of an adjoining carpet base 30 and are not limited by the examples demonstrated in the figures.

Similar to the embodiment described above, this embodiment may include at least one sensor to detect the presence of dirt and/or moisture in the carpet fiber groups 56 and such detection may cause the self-cleaning process to initiate automatically. Alternatively, the sensor may provide a notification of the presence of dirt and/or moisture in the carpet fiber groups 56 to alert a user of the need to initiate the self-cleaning process.

The invention claimed is:

1. A self-cleaning carpet system comprising:
- a carpet base;
- a cleaning tube mounted in the carpet base;
- a piston operably mounted with respect to the cleaning tube for movement between a retracted position and an extended position;
- a carpet fiber group attached to the piston, wherein when the piston is in the retracted position, the carpet fiber group is substantially inside the cleaning tube and wherein when the piston is in the extended position, at least a portion of the carpet fiber group extends from the cleaning tube;
- a water assembly fluidly connected to the cleaning tube for delivering water to the cleaning tube; and
- a vacuum assembly fluidly connected to the cleaning tube for applying a vacuum to the cleaning tube.

2. The self-cleaning carpet system of claim 1, wherein the carpet base comprises:
- a lower base portion;
- an upper base portion; and
- a fastening mechanism that mounts the lower base portion with respect to the upper base portion.

3. The self-cleaning carpet system of claim 1, wherein the cleaning tube has a bore at least partially extending therethrough and wherein the piston is mounted at least partially in the bore.

4. The self-cleaning carpet system of claim 1, wherein the cleaning tube has an upper end and a lower end, wherein the water assembly is fluidly connected to the cleaning tube proximate the upper end and wherein the vacuum assembly is fluidly connect to the cleaning tube proximate the lower end.

5. The self-cleaning carpet system of claim 1, wherein the piston comprises a guide pin mounted thereto so that at least one end of the guide pin extends from the piston, wherein the cleaning tube has a slot formed therein, wherein the guide pin seats in the slot to permit the piston to slide with respect to the cleaning tube and wherein the slot limits a distance that the piston is slidable with respect to the cleaning tube.

6. The self-cleaning carpet system of claim 5, wherein the piston is oriented about a first axis, wherein the guide pin is oriented about a second axis and wherein the first axis is generally perpendicular to the second axis.

7. The self-cleaning carpet system of claim 1, wherein the cleaning tube comprises a plurality of cleaning tubes and wherein the water assembly comprises:
- a master water line fluidly connected to a water source; and
- a plurality of water delivery lines fluidly connected to the master water line, wherein the plurality of the water delivery lines are individually fluidly connected to the plurality of cleaning tubes.

8. The self-cleaning carpet system of claim 1, wherein the cleaning tube comprises a plurality of cleaning tubes and wherein the vacuum assembly comprises:
- a master vacuum line fluidly connected to a vacuum source; and
- a plurality of vacuum delivery lines fluidly connected to the master vacuum line, wherein the plurality of vacuum delivery lines are individually fluidly connected to the plurality of cleaning tubes.

9. The self-cleaning carpet system of claim 1, wherein the cleaning tube comprises a plurality of cleaning tubes and wherein the plurality of cleaning tubes are oriented in a plurality of rows and a plurality of columns in the carpet base.

10. The self-cleaning carpet system of claim 1, wherein the vacuum assembly is fluidly connected to a source that is capable of providing a positive air pressure and a negative air pressure.

11. A method of cleaning a self-cleaning carpet system, wherein the method comprises:
- providing a self-cleaning carpet system comprising a carpet base, a cleaning tube, a piston, a carpet fiber group, a water assembly and a vacuum assembly, wherein the cleaning tube is mounted in the carpet base, wherein the piston is operably mounted with respect to the cleaning tube for movement between a retracted position and an extended position, wherein the carpet fiber group is attached to the piston, wherein the water assembly is fluidly connected to the cleaning tube and wherein the vacuum assembly is fluidly connected to the cleaning tube, positioning the piston in the retracted position where the carpet fiber group is substantially inside the cleaning tube;

delivering water to the cleaning tube so that the water passes through the carpet fiber group;

activating the vacuum assembly to remove the water from the carpet fiber group; and moving the piston to the extended position where at least a portion of the carpet fiber group extends from the cleaning tube.

12. The method of claim 11, wherein activating the vacuum assembly causes the piston to move between the extended position and the retracted position.

13. The method of claim 11, wherein the carpet base comprises a lower base portion, an upper base portion and a fastening mechanism, wherein the fastening mechanism mounts the lower base portion with respect to the upper base portion.

14. The method of claim 11, wherein the cleaning tube has an upper end and a lower end, wherein the water assembly is fluidly connected to the cleaning tube proximate the upper end and wherein the vacuum assembly is fluidly connect to the cleaning tube proximate the lower end.

15. The method of claim 11, wherein the piston comprises a guide pin mounted thereto so that at least one end of the guide pin extends from the piston, wherein the cleaning tube has a slot formed therein, wherein the guide pin seats in the slot to permit the piston to slide with respect to the cleaning tube and wherein the slot limits a distance that the piston is slidable with respect to the cleaning tube.

16. The method of claim 15, wherein the piston is oriented about a first axis, wherein the guide pin is oriented about a second axis and wherein the first axis is generally perpendicular to the second axis.

17. The method of claim 11, wherein the cleaning tube comprises a plurality of cleaning tubes, wherein the water assembly comprises a master water line and a plurality of water delivery lines, wherein the master water line is fluidly connected to a water source, wherein the plurality of water delivery lines is fluidly connected to the master water line and wherein the plurality of the water delivery lines are individually fluidly connected to the plurality of cleaning tubes.

18. The method of claim 11, wherein the cleaning tube comprises a plurality of cleaning tubes, wherein the vacuum assembly comprises a master vacuum line and a plurality of vacuum delivery lines, wherein the master vacuum line is fluidly connected to a vacuum source, wherein the plurality of vacuum delivery lines is fluidly connected to the master vacuum line and wherein the plurality of vacuum delivery lines are individually fluidly connected to the plurality of cleaning tubes.

19. The method of claim 11, and further comprising:

sensing moisture in the carpet fiber group; and activating the vacuum assembly to remove the moisture from the carpet fiber group.

20. The method of claim 11, and further comprising:

detecting at least one of the carpet fiber group needing to be cleaned; and activating the carpet fiber cleaning method.

* * * * *